United States Patent [19]

Okuda et al.

[11] Patent Number: 4,643,068

[45] Date of Patent: Feb. 17, 1987

[54] ELECTRONIC MUSICAL INSTRUMENT WITH AUTOMATIC RHYTHM PLAYING UNIT

[75] Inventors: Hiroko Okuda; Keiichi Sakurai; Junichi Minamitaka, all of Tokyo, Japan

[73] Assignee: Casio Computer Co., Ltd., Tokyo, Japan

[21] Appl. No.: 730,352

[22] Filed: May 3, 1985

[30] Foreign Application Priority Data

May 16, 1984 [JP] Japan ..... 59-70313[U]

[51] Int. Cl.[4] ..... G10F 1/00

[52] U.S. Cl. ..... 84/1.03; 84/DIG. 12

[58] Field of Search ..... 84/1.03, DIG. 12

[56] References Cited

U.S. PATENT DOCUMENTS 4,350,071 9/1982 Kondo ..... 84/DIG. 12

4,351,215 9/1982 van der Bruggen ..... 84/DIG. 12

4,357,854 11/1982 Hirano ..... 84/DIG. 12

*Primary Examiner*—Russell E. Adams

*Attorney, Agent, or Firm*—Frishauf, Holtz, Goodman & Woodward

[57] ABSTRACT

When the fill-in key and synchro start key are operated, an output of an inverter causes an AND gate to inhibit the resetting of a flip-flop by an output of a bar clock generator. In consequence, a fill-in rhythm is sounded continuously with a pattern selector driven by the set output of the flip-flop. When an accompaniment play key is operated at a desired instant in this situation, an output of a key depression detection circuit is fed through an AND gate and an OR gate to the reset input terminal of the flip-flop. As a result, the address of a ROM designated by the pattern selector, is changed to start sounding of normal rhythm.

5 Claims, 2 Drawing Figures

ELECTRONIC MUSICAL INSTRUMENT WITH AUTOMATIC RHYTHM PLAYING UNIT

BACKGROUND OF THE INVENTION

This invention relates to an electronic musical instrument with an automatic rhythm playing unit.

An electronic musical instrument with an automatic rhythm playing function usually has a rhythm start/stop switch, an intro-fill-in switch and a synchro start switch, these switches serving as rhythm control switches. The synchro start switch is used when starting a normal rhythm in synchronism with the operation of an accompaniment key.

When the intro-fill-in switch is turned on before the start of performance, the intro-fill-in is produced in response to the operation of an accompaniment key and continued for the first bar or two bars before being switched over to the normal rhythm. When the intro-fill-in switch is turned on after the rhythm start, the fill-in is produced for the immediately succeeding bar or two bars before being switched over to the normal rhythm.

The length of the intro usually varies with music played. However, the intro-fill-in is produced only for one bar or two bars as noted above. Therefore, there are many cases when it is impossible to provide an intro-fill-in that is fitted to the music to be played.

Further, in order to produce a fill-in rhythm as a play pattern, i.e., for a somewhat long period of time, the fill-in switch has to be repeatedly turned on for every bar or every two bars. In this case, one hand, for example, left hand has to be exclusively used for operating the fill-in switch, so that only the remaining hand can be used for operating accompaniment keys, thus sometimes giving rise to trouble in the performance of the accompaniment.

SUMMARY OF THE INVENTION

An object of the invention is to provide an electronic musical instrument with an automatic rhythm playing unit, which permits an extra rhythm other than the normal rhythm, e.g., an intro-fill-in or a fill-in, to be produced for a desired period of time irrespective of whether a normal rhythm start has been made.

According to the invention, there is provided an electronic musical instrument with an automatic rhythm playing unit, which comprises rhythm generating means for selectively generating rhythm pattern data of a normal rhythm and a plurality of extra rhythms other than the normal rhythm, a rhythm designation means for designating one of the rhythm pattern data, an accompaniment keyboard, tone generating means for generating a tone corresponding to an operated key on the accompaniment keyboard, and control means including means functioning in response to the key operation to stop the sounding of extra rhythm while the extra rhythm designated by the rhythm designation means is being sounded.

DETAILED DESCRIPTION OF THE PREFERRED EMBODIMENT

Now, an embodiment of the invention will be described with reference to the drawings.

Figure 1:
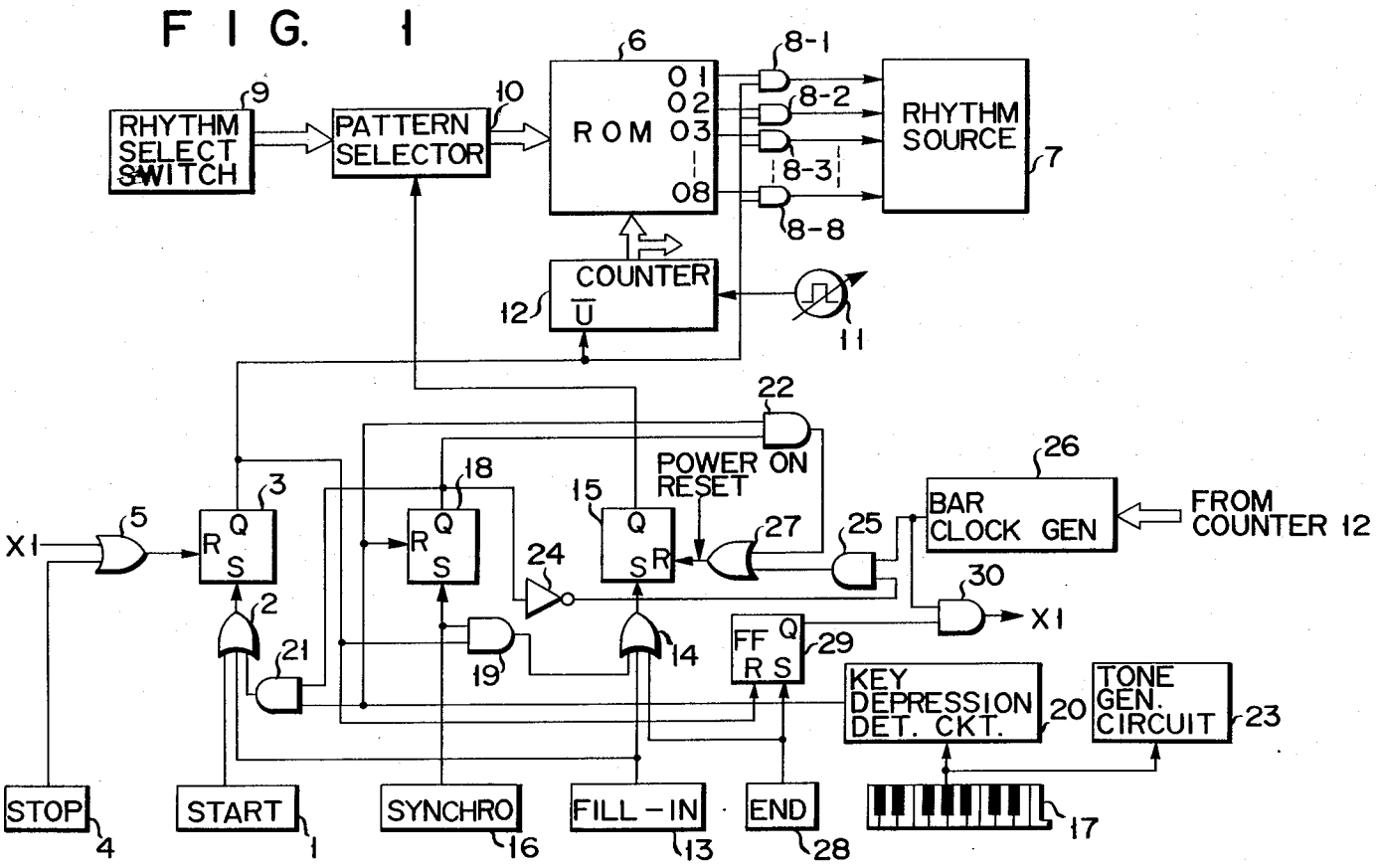
FIG. 1 is a schematic representation of an embodiment of the electronic musical instrument with an automatic rhythm playing unit according to the invention.

As shown in FIG. 1, an output of a start switch 1 is fed through an OR gate 2 to a set input terminal S of an R-S flip-flop 3. An output of a rhythm stop switch 4 is fed through an OR gate 5 to a reset input terminal R of the flip-flop 3. A set output signal of the flip-flop 3 is fed as a gate control signal to one input terminal of each of AND gates 8-1 to 8-8 provided between a ROM (read only memory) 6 and rhythm source 7.

In the ROM 6 are stored different rhythm pattern data of a plurality of normal rhythms and fill-in rhythms. When a rhythm select switch 9 is operated, a pattern selector 10 is driven to read out one of the different rhythm pattern data as 8-bit parallel data. The read-out data is fed from output terminals 01 to 08 through the AND gates 8-1 to 8-8 to the rhythm source 7, so that the pertinent rhythm is sounded through an amplifier and a loudspeaker (not shown).

For reading the pattern data noted above, the ROM 6 is addressed by a count output of a counter 12, which counts a tempo clock produced from a tempo clock generator 11. The counter 12 receives the set output signal of the flip-flop 3 which is supplied as a control signal, and performs counting when the set output signal is at "1" level.

A fill-in switch 13 is provided for starting an intro-fill-in rhythm, for instance. The output of the fill-in switch 13 is fed to the OR gate 2, and is also fed through an OR gate 14 to the set input terminal S of an S-R flip-flop 15. A synchro-start switch 16 is provided for starting the normal rhythm in synchronism to the operation of a key on an accompaniment keyboard 17. The output of the synchro-start switch 16 is fed to the set input terminal S of an S-R flip-flop 18 and also to an AND gate 19.

The output of the accompaniment keyboard 17 is fed to a key depression detection circuit 20. The key depression detection circuit 20 checks whether each key switch is "on" or "off". Its detection signal is fed to the reset input terminal R of the flip-flop 18 and also to AND gates 21 and 22. The output of the accompaniment keyboard 17 is fed to a tone generation circuit 23, which produces a tone signal which is in turn fed to a loudspeaker (not shown) for sounding.

The set output of the flip-flop 3 is fed to the AND gate 19 whose output is fed to the OR gate 14. The set output of the flip-flop 18 is fed to the AND gates 21 and 22 and also fed through an inverter 24 to the AND gate 25. A bar clock generator 26 generates bar clock pulses each produced for each bar in response to the count output of the counter 12. The bar clock is fed to the other input terminal of the AND gate 25 whose output is fed to the reset terminal of the flip-flop 15 via the OR gate 27. The set output of the flip-flop 15 is fed as a drive signal to the pattern selector 10. The pattern selector 10 feeds to the ROM 6 address data for selecting either normal rhythm data or intro data to be read out from the ROM 6.

An ending switch 28 is provided in addition to the fill-in switch 13. The output of the switch 28 is fed through the OR gate 14 to the set input terminal of flip-flop 15 and also to the set input terminal of a flip-flop 29. The Q output of the flip-flop 29 is fed along with the output of the bar clock generator 26 to an AND gate 30, and the output thereof is fed through the OR gate 5 to the reset input terminal of the flip-flop 3. The Q output of the flip-flop 3 is also fed to the reset terminal of the flip-flop 29.

The operation of the system shown in FIG. 1 will now be described with reference to FIG. 2. When a power source switch (not shown) is turned on, a reset signal is fed to the reset input terminal of the flip-flop 15 to reset this flip-flop 15.

In this state, when the rhythm start switch 1 alone is turned on, the flip-flop 3 is set to provide a set output of "1". The AND gates 8-1 to 8-8 are thus enabled and the flip-flop 29 is reset. The counter 12 is also driven to start counting to address the ROM 6. Since at this time the flip-flop 15 is reset, i.e., a set output of "0" is being fed therefrom to the pattern selector 10, the pattern selector 10 gives the ROM 6 a signal designating an address for reading out a normal rhythm from the ROM 6. Thus, normal rhythm pattern data selected by the rhythm select switch 9 is read out from the ROM 6 to be fed through the AND gates 8-1 to 8-8 to the rhythm source 7, whereby the normal rhythm is produced as shown in (a) in FIG. 2. When the rhythm stop switch 4 is turned on during the sounding of the normal rhythm, the flip-flop 3 is reset to disable the AND gates 8-1 to 8-8, so that the normal rhythm is stopped.

When a synchro start switch 16 is turned on during the sounding of the normal rhythm as started with the "on" operation of the rhythm start switch 1, the flip-flop 18 is set and the flip-flop 15 is set since the AND gate 19 has been enabled. Thus, a set output of "1" is fed from the flip-flop 15 to the pattern selector 10, so that the pattern selector 10 gives the ROM 6 a signal designating an address for reading out intro-fill-in pattern data. The intro-fill-in is thus started in lieu of the previous normal rhythm, as shown in (b) in FIG. 2. During this time, the AND gates 21 and 22 are enabled while the AND gate 25 is disabled by a set output of "1" from the flip-flop 18.

When a key on the accompaniment keyboard 17 is depressed in this situation, the detection signal of the key depression detection circuit 18 goes to "1" to set the flip-flop 3 and reset the flip-flops 18 and 15. The pattern selector 10 thus designates a normal rhythm, so that the normal rhythm is sounded together with the tone of the accompaniment key in lieu of the previous intro-fill-in.

When only the fill-in switch 13 is turned on while both the rhythm start switch 1 and synchro start switch 16 are both "off" so that there is no rhythm being produced, the flip-flops 3 and 15 are simultaneously set. As a result, the AND gates 8-1 to 8-8 are enabled, and the counter 12 starts counting. Further, the pattern selector 10 designates intro-fill-in pattern data, so that the sounding of the intro-fill-in is started, as shown in (c) in FIG. 2. Since the flip-flop 18 has been reset, i.e., the AND gate 25 has been enabled, after a bar clock pulse is produced from the bar clock generator 26 to reset the flip-flop 15, whereupon the intro-fill-in is stopped and the normal rhythm is resumed in lieu thereof. It is to be noted that in this case the intro-fill-in is produced for one bar only.

When the fill-in switch 13 is turned on after the synchro start switch 16 has been turned on, the AND gate 25 is disabled to inhibit the resetting of the flip-flop 15 by the bar clock. Thus, with the closure of the fill-in switch 13 the flip-flops 3 and 15 are set to start the sounding of the intro-fill-in, as shown in (d) in FIG. 2. When an accompaniment key is subsequently operated after the lapse of a given period of time, both the flip-flops 18 and 15 are simultaneously reset, so that the intro-fill-in is stopped and the normal rhythm is resumed in lieu thereof.

Figure 2:
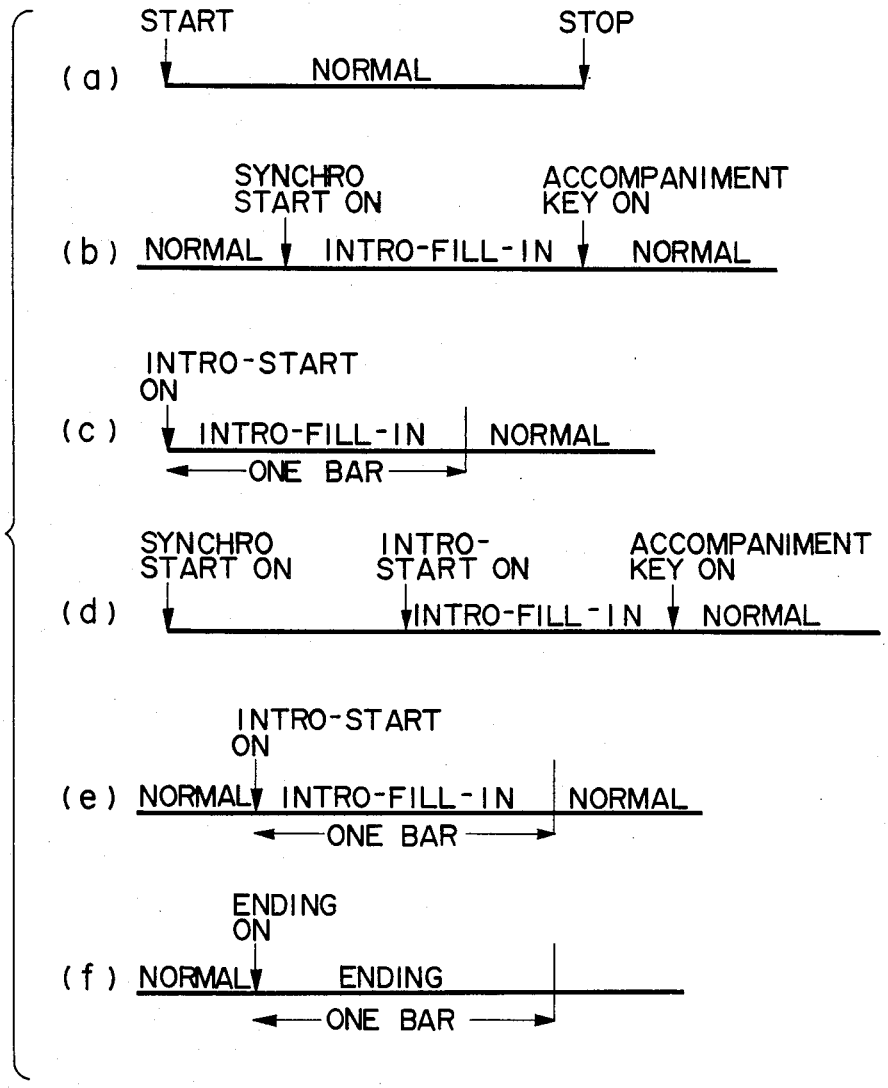
FIG. 2 is a timing chart for explaining the operation of the circuit shown in FIG. 1.

When the fill-in switch 13 is turned on during the sounding of the normal rhythm started with the closure of the rhythm start switch 1, the intro-fill-in is started in substitution for the normal rhythm, as shown in (e) in FIG. 2. Since the synchro start switch 16 has been "off", i.e., the AND gate 25 has been enabled, the intro-fill-in is continued for only one bar and is switched over to the normal rhythm with the appearance of a bar clock pulse at the start of the next bar.

While in the above embodiment the sounding of the intro-fill-in is started with the closure of the synchro start switch 16 or fill-in switch 13 during the sounding of the normal rhythm, this is by no means limitative, it is possible to cause the start of fill-in rhythm. Further, it is possible to produce an ending rhythm other than the normal rhythm.

In this case, the ending switch 28 is turned on, so that the pattern selector 10 is driven by the set output of the flip-flop 15 for designating the address of the ROM 6. The ending rhythm is thus sounded as shown in (f) in FIG. 2. After the lapse of one bar period, the flipflop 3 is reset by the output of the bar clock generator 26 fed through the AND gate 30 and OR gate 5. The AND gates 8-1 to 8-8 are thus disabled to stop the ending rhythm. If the AND gate 25 is disabled with the set output of the flip-flop 29 when the ending switch 28 is turned on, the ending rhythm is sounded for a desired period of time until the stop key 4 is operated.

As has been described, with the electronic musical instrument with an automatic rhythm playing unit, extra rhythms other than the normal rhythm, e.g., intro-fill-in and fill-in, may be produced for a desired period of time. Besides, the intro-fill-in and fill-in can be started from any desired instant of an automatic rhythm playing and continued for a desired period of time and, what is more, depending on the key operation state of the accompaniment keyboard. Thus, a greatly improved effect can be obtained compared to the prior art.

What is claimed is:

1. An electronic musical instrument with an automatic rhythm playing unit comprising:

rhythm generating means for selectively generating rhythm pattern data of a normal rhythm and a plurality of extra rhythms other than said normal rhythm;

rhythm designation means for designating one of said rhythm pattern data;

an accompaniment keyboard;

tone generating means for generating a tone corresponding to an operated key on said accompaniment keyboard; and control means including means for functioning in response to a key operation of said accompaniment keyboard to stop the sounding of an extra rhythm while said extra rhythm designated by said rhythm designation means is being sounded and to start the sound of said normal rhythm.

2. The electronic musical instrument according to claim 1, wherein said extra rhythm is at least one of an ending, an intro-fill-in and a fill-in, and said rhythm designation means includes normal rhythm designation means for designating a normal rhythm and extra rhythm designating means for designating at least one extra rhythm other than the normal rhythm.

3. The electronic musical instrument according to claim 2, wherein said rhythm designation means includes synchro start means for starting the sounding of said normal rhythm in synchronism to said key operation on the accompaniment keyboard, and said control means includes means for causing said extra rhythm to be produced until an instant of key operation on the accompaniment keyboard in accordance with an "on" operation of said extra rhythm designation means while a synchro start state is set by said synchro start means, and means for causing said extra rhythm to be produced for a predetermined period of time in accordance with an "on" operation of said synchro start means while the synchro start state is not set by said synchro start means.

4. The electronic musical instrument according to claim 2, wherein said rhythm designation means includes a synchro start means for synchronously starting the generation of said normal rhythm with the key operation on said accompaniment keyboard, and said control means includes means for continuously generating said extra rhythm, until a key on said accompaniment keyboard is operated, in response to an "on" operation of said synchro start means, while a normal rhythm is being designated by said normal rhythm designation means.

5. The electronic musical instrument according to claim 1, wherein said rhythm designation means includes normal rhythm select means for producing an output for selecting one of a plurality of normal rhythms, an extra rhythm select means including an extra select switch for producing an output for selecting an extra rhythm and a first flip-flop set by the output of said extra rhythm select switch, a pattern selector for producing a plurality of address signals corresponding to said normal rhythm designation output and set output of said first flip-flop, a start switch and a stop switch for starting and stopping the rhythm sounding, respectively, and a second flip-flop set in response to the operation of said start switch and reset in response to the operation of said stop switch, and said rhythm generating means includes a ROM for delivering rhythm data corresponding to said address signal, AND gate means supplied with output rhythm data of said ROM and enabled and disabled according to the setting and resetting of said second flip-flop, and a rhythm source driven according to the output of said AND gate means.

* * * * *